US006672120B1

(12) United States Patent
Ghiran et al.

(10) Patent No.: US 6,672,120 B1
(45) Date of Patent: Jan. 6, 2004

(54) IN-DIE HYDROPIERCING APPARATUS WITH PREPIERCING ADJUSTMENT

(75) Inventors: Mircea M. Ghiran, Lake Orion, MI (US); Bruce S. Shimanovski, Southfield, MI (US); Glenn M. Krcek, Sterling Heights, MI (US)

(73) Assignee: General Motors Corporation, Detroit, MI (US)

( * ) Notice: Subject to any disclaimer, the term of this patent is extended or adjusted under 35 U.S.C. 154(b) by 0 days.

(21) Appl. No.: 10/368,247

(22) Filed: Feb. 18, 2003

(51) Int. Cl.[7] ..... B21D 26/02; B21D 28/10

(52) U.S. Cl. ..... 72/55; 29/421.1; 83/53

(58) Field of Search ..... 72/55, 56; 29/421.1; 83/53, 54

(56) References Cited

U.S. PATENT DOCUMENTS 5,398,533 A 3/1995 Shimanovski et al. ..... 72/55
5,765,420 A * 6/1998 Schaefer ..... 72/55
6,341,514 B2 * 1/2002 Engel et al. ..... 72/55
6,401,507 B1 6/2002 Krcek et al. ..... 72/55

* cited by examiner

*Primary Examiner*—David B. Jones
(74) *Attorney, Agent, or Firm*—Charles E. Leahy

(57) ABSTRACT

Hydroforming apparatus includes in-die hydropiercing apparatus with easy and precise adjustment of the positioning of a backup plunger that is received in a die button and is positioned in a hydroforming position, a prepiercing position, a piercing position, and a slug ejecting position that may be outside the plunger or may be the hydroforming position. Wherein the plunger is required to be precisely positioned and held in the prepiercing position in the die button in order to obtain a desired prepiercing action without prematurely piercing the hydroformed part. The in-die hydropiercing apparatus has a plunger actuating hydraulic cylinder that moves the plunger to the different positions and a cam actuating hydraulic cylinder that positions a cam in determining the prepiercing position of the plunger. The cam actuator includes an adjusting device that provides for easily adjusting positioning of the plunger with the cam in the required prepiercing position and the cam with its hydraulic actuator also acts to hold the plunger in the prepiercing position thereby relieving the plunger actuating hydraulic cylinder of this duty.

27 Claims, 12 Drawing Sheets

IN-DIE HYDROPIERCING APPARATUS WITH PREPIERCING ADJUSTMENT

TECHNICAL FIELD

This invention relates to in-die hydropiercing apparatus with prepiercing adjustment and more particularly to the adjustable positioning and holding of the backup plunger in determining the amount of hydroprepiercing allowed prior to actual hydropiercing.

BACKGROUND OF THE INVENTION

In the hydroforming of a part, it is well known that one or more holes required in a hydroformed part may be pierced in the part while the part remains in the dies by using the hydroforming pressure to effect the piercing immediately following the forming of the part with this pressure. Thereby eliminating the need to form the holes in a subsequent operation such as by drilling, plasma cutting or laser cutting after the part has been removed from the hydroforming dies. And in view of how such prepiercing and subsequent piercing is accomplished, the actual piercing is referred to herein as hydropiercing and the prepiercing that is performed prior thereto and immediately following the hydroforming of the part is referred to herein in similar manner as hydroprepiercing as both such operations are performed with the hydroforming fluid used to form the part.

Prior known hydroforming apparatus including in-die hydropiercing apparatus that is believed relevant is found in U.S. Pat. No. 5,398,533 that is assigned to the assignee of this invention. Wherein a die button is mounted in the lower die so that an outer surface of the die button forms a continuation of the die cavity surface. A backup plunger is received in the die button and a wedge shaped cam is positioned with a hydraulic cylinder or other suitable cam actuator and operates on one end of the plunger to position the plunger in (1) a hydroforming position so that the other end (the working end) of the plunger is flush with the outer surface of the die button for the hydroforming of the part, (2) a retracted piercing position in the die button allowing the hydroforming pressure in the part to pierce or shear the part with the cutting edge of the die button in a hydropiercing operation and wherein the slug resulting from such hydropiercing is deposited on the working end of the plunger immediately following the hydroforming of the part, and (3) a further retracted position outside of and behind the die button allowing ejection of the slug from the plunger and out of the lower die.

Other prior known hydroforming apparatus including in-die hydroprepiercing and hydropiercing apparatus that is also believed relevant is disclosed in U.S. patent application Ser. No. 09/997,369 filed Nov. 30, 2001 and also assigned to the assignee of this invention. In the latter hydroforming apparatus, there is no intermediary cam device and either one hydraulic cylinder or two hydraulic cylinders are used to establish the prepiercing and piercing positions of the backup plunger. Wherein as to the former plunger position, the working end of the backup plunger is positioned in a partially retracted intermediate and predetermined prepiercing position in the die button that allows the hydroforming pressure to stretch a section of the part over the cutting edge of the die button and only partially into the die button and against the outer end of the plunger. This prepiercing action, that may also be referred to as a hydropreshearing operation, weakens but does not pierce this section of the part at the cutting edge of the die button and thereby allows reduced hydroforming pressure less prone to leakage past plunger to effect the piercing when the end of the plunger is then further retracted to its piercing position. However, in this case the plunger with the slug having been deposited thereon is then returned to its hydroforming position following removal of the pierced hydroformed part from the lower die where after the slug is then ejected from the lower die with an ejection mechanism through an opening in this die's die cavity surface.

Where such advantageous hydroprepiercing or preshearing is to be implemented in the in-die piercing of a hole with hydroforming fluid pressure, it is important that the working end of the backup member be accurately and reliably positioned in both the desired hydroforming position and the prepiercing position as otherwise the part may either not be weakened to the extent desired because of insufficient plunger retraction in the die button. Or the part may be prematurely pierced because of excessive plunger retraction in the die button.

In the aforementioned U.S. Pat. No. 5,398,533, the hydroforming position of the backup plunger is determined by the plunger having a shoulder that engages an internal stop provided on the die button and the plunger is moved to this position and eventually allowed to move to its piercing and slug ejecting positions by the hydraulic cylinder operated cam. And there is no means disclosed for adjusting the positioning of the plunger as its hydroforming position can be accurately determined by the stop and the other plunger positions; namely the piercing and slug ejecting positions, would not normally require any adjustment provided all the relevant parts are made to their required dimensions within prescribed tolerances and installed properly.

On the other hand, in the aforementioned U.S. patent application Ser. No. 09/997,369, accurate location of both the hydroforming position and the prepiercing position of the backup plunger is critical and there is disclosed therein in one embodiment mechanical means in the form of a fine threaded adjustment device for accurately adjusting the prepiercing plunger position while relying on a fixed stop at the end of a first hydraulic cylinder to accurately determine the hydroforming plunger position. The hydraulic force of a second hydraulic cylinder is required to hold both these positions in this embodiment and the adjustment device does not lend itself to providing adjustment of the prepiercing plunger position where it is desired to use the rigidity of a pure mechanical device. Rather than a hydraulic force to hold the backup plunger in its prepiercing position against the force of the high hydroforming fluid pressure in the part that can for example reach 25,000 psi. In another embodiment in the above-identified patent application, a mechanical stop provided in the die button determines the hydroforming/slug ejecting position of the plunger that is actuated by a single hydraulic cylinder. And the prepiercing position is effected by controlled partial exhaust of the hydraulic cylinder that can be adjusted to obtain the desired degree of hydroprepiercing and wherein the piercing plunger position is established by completely exhausting this hydraulic cylinder.

While the above backup plunger positioning devices have proven generally satisfactory, there remains a desire for being able in the case of prepiercing the hydroformed part to easily and finely adjust the prepiercing position of the plunger and thereby precisely control the degree of extrusion of the part into the die button without allowing actual piercing of the part at the high hydroforming pressure and without requiring the use of a hydraulic force to hold this critical plunger position. And especially when it is desired to somehow relieve a plunger positioning hydraulic cylinder of having to both establish and hold the plunger in its prepiercing position against the large hydroforming force in the part acting on the plunger in this plunger position.

SUMMARY OF THE INVENTION

The present invention provides for easy and precise adjustment of the positioning of a backup plunger where the plunger is required to be precisely positioned in a certain prepiercing position in order to obtain the desired hydro-prepiercing action without premature piercing of the part and with a lowered hydroforming fluid pressure in the part being hydroformed that is less prone to leakage past the plunger. This is accomplished with in-die hydropiercing apparatus that basically comprises a plunger actuating hydraulic cylinder, and a cam device that determines the prepiercing position with a wedge shape cam that is associated with the plunger and is positioned by a cam actuating hydraulic cylinder having a piston rod whose positioning and thus that of the cam and thereby the prepiercing position is easily and finely adjustable. Moreover, the wedge shaped cam is also utilized to resist the force of the high hydroforming pressure acting in the part and on the plunger during both the prepiercing operation and the actual piercing operation thereby relieving the plunger actuating hydraulic cylinder of this task for these operations.

Both the hydroforming position and the prepiercing position of the backup plunger are easily adjustable in one embodiment with separate fined threaded adjusting screw devices associated with the hydraulic cylinders wherein one adjusting screw device is directly associated with the plunger actuating hydraulic cylinder and a cam positioning adjusting screw device is directly associated with the cam actuating hydraulic cylinder. And the wedge shaped cam in this one embodiment is interposed between the backup plunger and the piston rod of the plunger actuating hydraulic cylinder.

In another embodiment, the two hydraulic cylinders are arranged in tandem and the cam is interposed between the piston rods of the two hydraulic cylinders. And only one adjusting screw device that is associated with the cam actuating hydraulic cylinder provides for adjusting and setting the prepiercing position of the backup plunger.

Moreover, in the case where multiple holes are to be pierced in the hydroformed part, the in-die hydropiercing apparatus of the present invention is also adapted so as to minimize the momentary delay between the piercings. And in a further embodiment, the in-die hydropiercing apparatus is both simplified and provides enhanced operation so that in the case of piercing multiple holes, the momentary delay time between piercings is eliminated. As well as the need to provide sealing between the plunger and the die button, thereby reducing the tolerances for the plunger and the die button and thus reducing their cost.

These and other aspects of the invention will become more apparent from the following detailed description of several exemplary embodiments of the present invention shown in the accompanying drawings.

DESCRIPTION OF EXEMPLARY EMBODIMENTS

Figure 1:
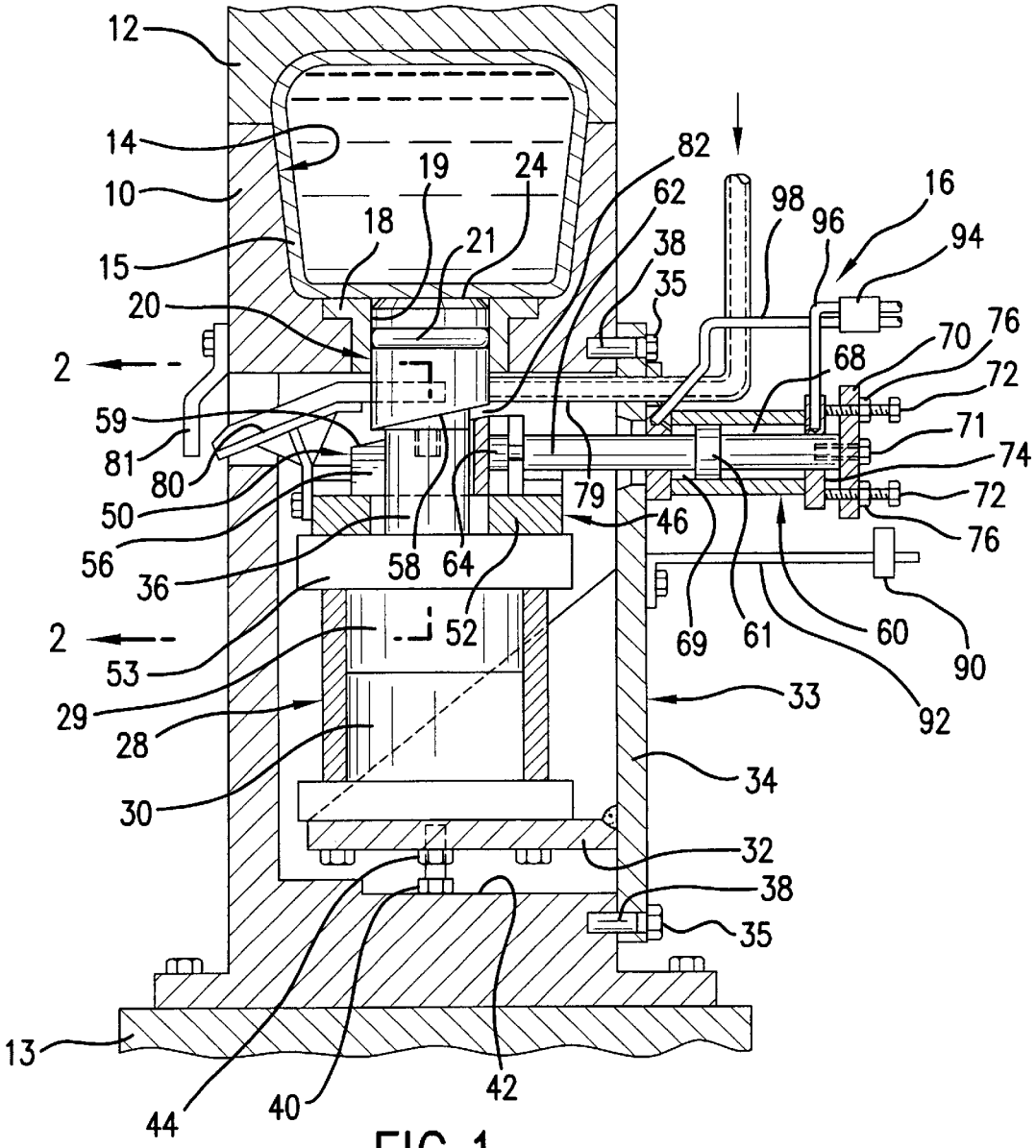
FIG. 1 is a partial transverse view mainly in section of hydroforming apparatus including in-die hydropiercing apparatus having backup plunger positioning adjustment means according to the present invention and wherein the backup plunger is shown in its hydroforming position and a fluid nozzle provides slug ejection.
Figure 2:
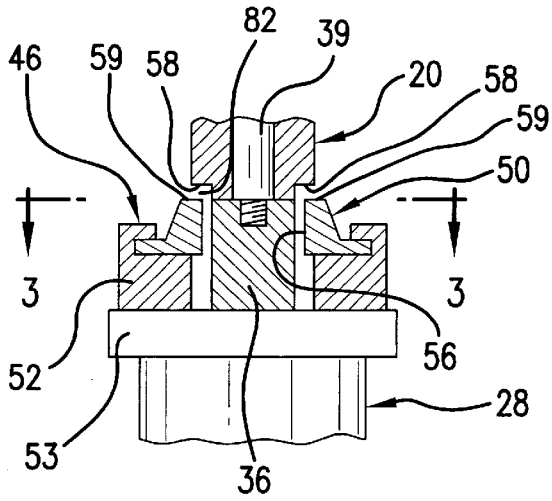
FIG. 2 is a view taken along the line 2—2 in FIG. 1 when looking in the direction of the arrows.
Figure 3:
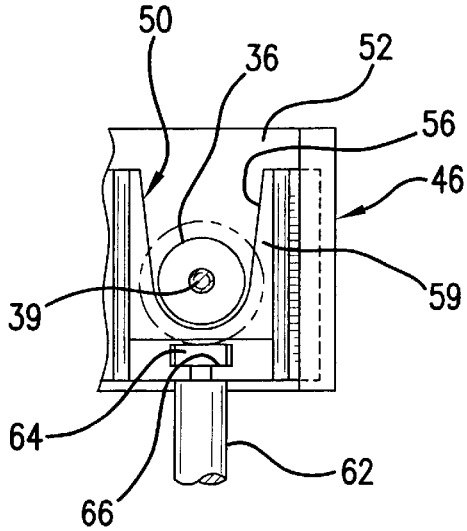
FIG. 3 is a view taken along the line 3—3 in FIG. 2 when looking in the direction of the arrows.

Referring to FIG. 1, there is shown hydroforming apparatus comprising a lower die 10 and an upper die 12 that are mounted in a conventional manner in a hydraulic press of which only a portion is shown and which includes a bedplate 13 to which the lower die is rigidly fastened. The dies 10 and 12 cooperate when pressed together to form a die cavity 14 for the hydroforming of a piece of tube stock into a tubular part 15 of a required shape. Wherein the hydroformed part 15 has the cross-sectional shape shown with a flat lower side in which a hole is required.

In the hydroforming process, a hydroforming fluid such as a high water based liquid solution is supplied at a suitable high pressure to the interior of the part via suitable means (not shown) that are commonly referred to as seal units and are operated to sealingly engage the ends of the part and subsequently provide for exhausting the hydroforming fluid from the part following its processing in the dies. The hydroforming apparatus as thus far described is of a conventional type and is operated in a conventional manner to form the part to the required shape and provide for its removal from the dies. Wherein following the hydroforming of the part, a hole required in the flat lower side of the part is pierced with in-die hydropiercing apparatus 16 according to the present invention.

The in-die hydropiercing apparatus 16 provides a hydro-prepiercing or hydropreshearing operation immediately following the hydroforming of the part and prior to the actual piercing of the part with this apparatus in order to produce the required hole in an advantageous manner. The hydro-prepiercing operation is accomplished in a manner like in the aforementioned U.S. patent application Ser. No. 09/997,369 that is hereby incorporated by reference for an expanded understanding of this phase of the in-die hydropiercing operation. Wherein such prepiercing and piercing provides a continuation of and the final phases of the hydroforming process in producing the required hydroformed and pierced part.

In the exemplary embodiment of the present invention shown in FIGS. 1–8, the hydroformed part requires a round hole to be pierced in the flat lower side thereof. And for that purpose the in-die hydropiercing apparatus 16 comprises a die button 18 with a circular cylindrical bore 19 that is fixed in the lower die 10 flush with the cavity forming surface of this die and at a location centered with respect to where the hole is required in the part. And a circular cylindrical backup plunger 20 that carries an O-ring seal 21 is received in the bore 19 with the seal engaging the surface of the bore to provide sealing during the piercing operation to contain the hydroforming fluid in the part. For the piercing of the required round hole in the part, the bore 19 in the die button 18 has a diameter that is sized to produce the diameter of the required hole and the plunger 20 has a diameter slightly smaller allowing it to slide in the bore with a close fit.

Figure 6:
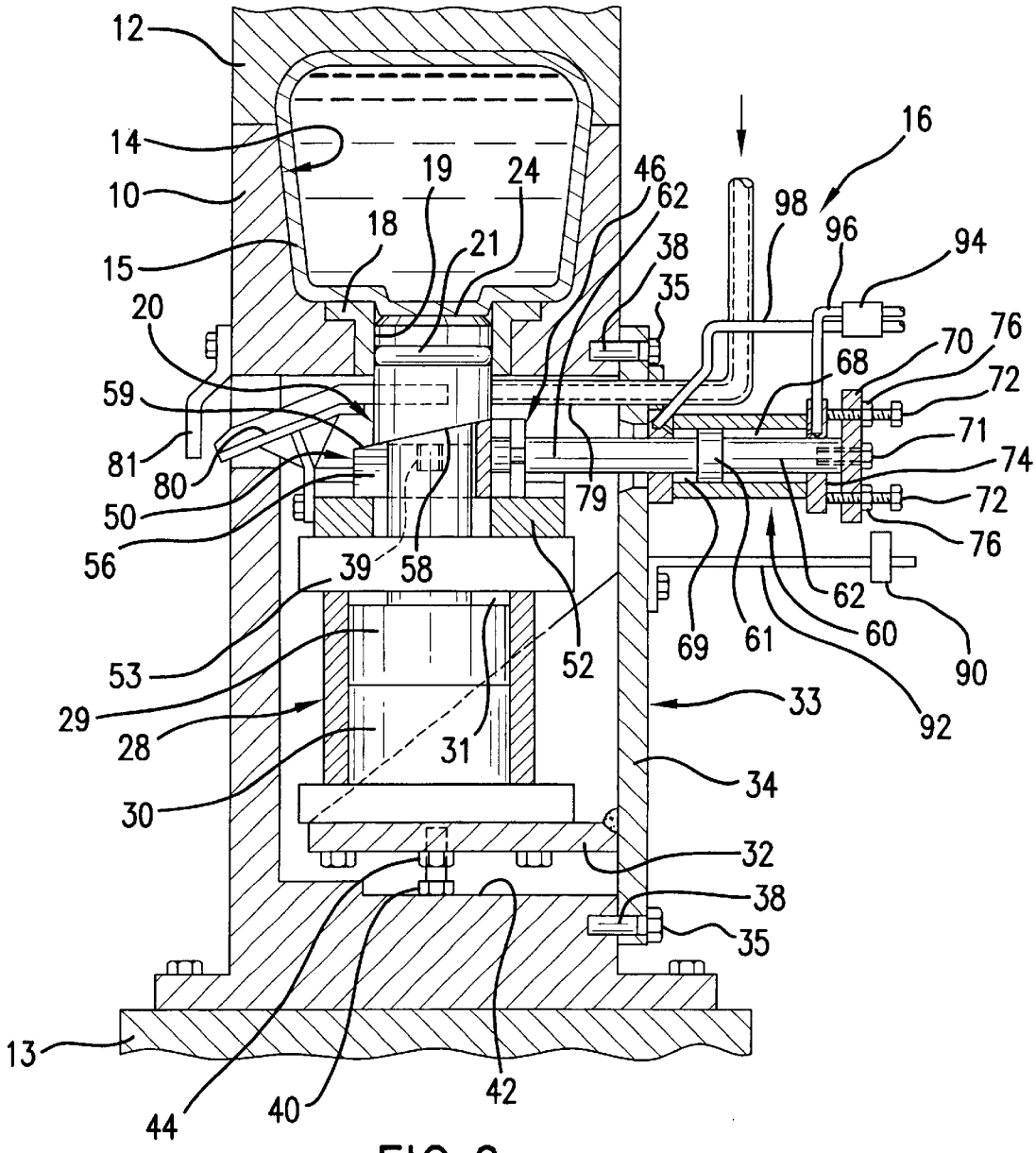
FIG. 6 is a view like FIG. 1 but showing the backup plunger in its prepiercing position.
Figure 7:
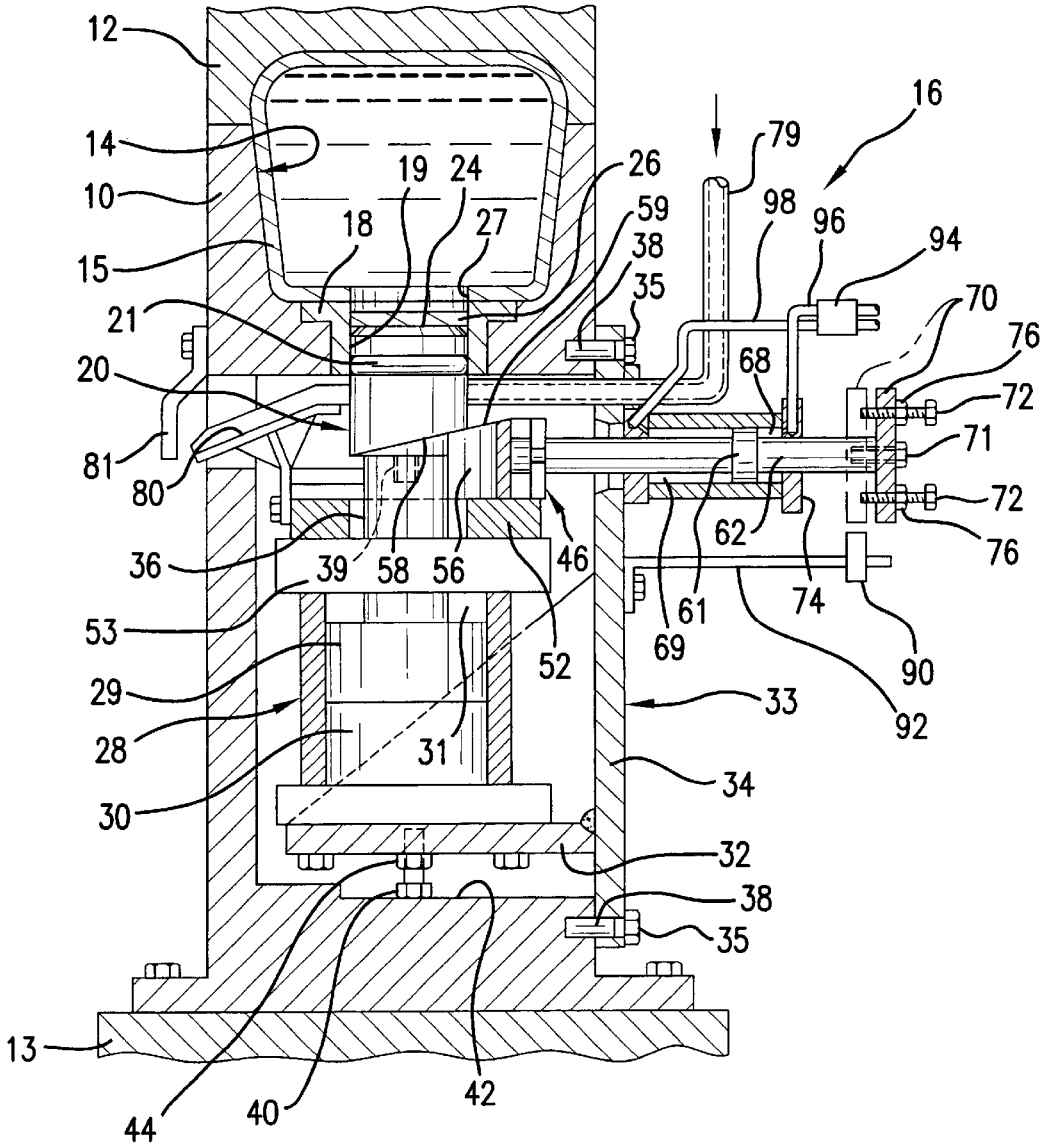
FIG. 7 is a view like FIG. 1 but showing the backup plunger in its piercing position.
Figure 8:
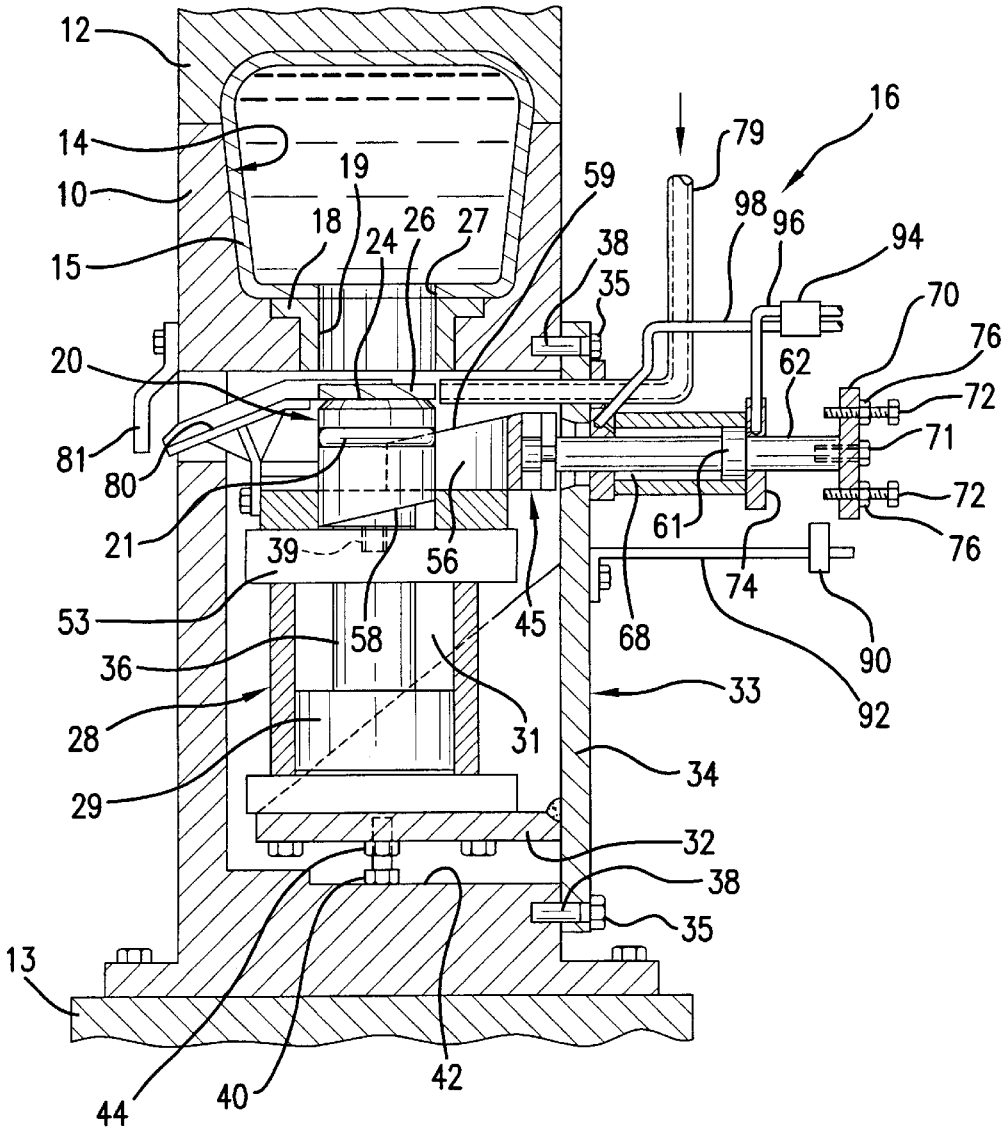
FIG. 8 is a view like FIG. 1 but showing the backup plunger in its slug ejecting position.

The backup plunger 20 is adapted to be positioned in the die button bore 19 so that one end 24 of the plunger, which has a chamfered edge and may also be referred to as the working end, is positioned in (1) a hydroforming position flush with the outer surface of the die button 18 during hydroforming of the part as shown in FIG. 1, (2) a slightly retracted prepiercing or preshearing position in the die button as shown in FIG. 6 for prepiercing or preshearing the part with the hydroforming pressure in the part, (3) a further retracted piercing position in the die button as shown in FIG. 7 for piercing the part with the hydroforming pressure in the part, and (4) a still further retracted slug ejecting position behind (below) the die button as shown in FIG. 8 that occurs after the hydroforming fluid has been exhausted from the hydroformed and pierced part. Wherein the latter plunger position as described in detail latter allows for the ejection of a slug 26 deposited on the plunger resulting from the piercing of the part in producing the required hole 27 in the part.

Backup plunger actuating means for establishing these plunger positions comprises an in-line hydraulic cylinder 28 having a piston 29 that is operated with a suitable hydraulic control system to position the plunger 20 in the manner described herein by supplying hydraulic fluid under pressure to and exhausting the hydraulic fluid from chambers 30 and 31 in the respective ends of the hydraulic cylinder 28. For such operation the hydraulic cylinder 28 is located in a side opening in the lower die 10 below the die cavity and is rigidly fastened to a base portion 32 of a mounting bracket 33. The mounting bracket further includes a side portion 34 that extends vertically at right angles to the base portion 32 and is rigidly fastened to the lower die 10 outside the side opening in the lower die. Such bracket attachment to the lower die being provided by bolts 35 that are received through vertically extending slots in the side portion 32 so as to allow vertical adjustment of the bracket 33 prior to tightening of the bolts as described in further detail later.

The piston 29 has a piston rod 36 that is rigidly joined thereto and is connected to the plunger 20 as described in detail later. And the mounting bracket 33 locates the piston rod 36 of the hydraulic cylinder 28 directly below and in axial alignment with the die button 18. With the proper location of the mounting bracket and thus the plunger actuating hydraulic cylinder 28 and its piston rod 36 assured by dowel pins 38 as further described later. Wherein the dowel pins 38 facilitate the changeover of the in-die hydro-piercing apparatus for a different hole piercing application and thus minimize the time required to accomplish such.

Figure 4:
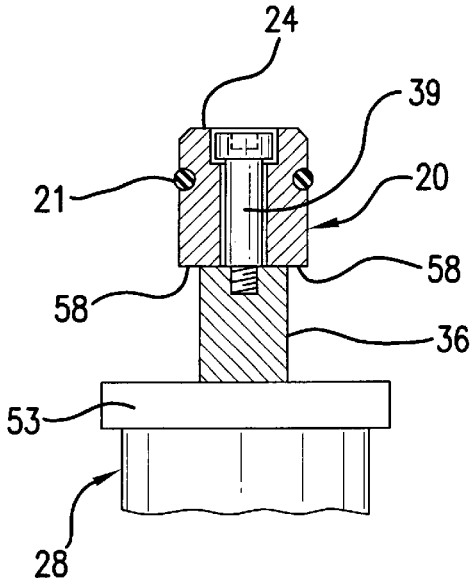
FIG. 4 is a view partially in section showing the manner in which the backup plunger is attached to the piston rod of the plunger actuating hydraulic cylinder in FIG. 1.

As shown in FIG. 4, the plunger 20 is fastened at its lower end by a shoulder screw 39 to the end of the piston rod 36 with both a radial clearance and axial clearance with such clearance provisions providing for minimizing the mounting accuracy requirements and thereby the cost to manufacture the plunger. And vertical adjustment of the plunger actuating hydraulic cylinder 28 and thereby the maximum extended position of its piston rod 36 and thus the plunger 20 is provided by a hex-headed adjusting screw 40 having a fine thread. Wherein the screw 40 is threaded to the base portion 32 of the mounting bracket 33 and the head of the screw abuts or contacts with a base portion 42 of the lower die 10 and is locked in the desired adjusting position by a jam nut 44 to establish the desired plunger position for the hydro-forming operation. And it is following this adjustment that the bolts 35 securing the mounting bracket 33 are then tightened and the dowel pins 38 located accordingly.

Referring to FIGS. 1–3 and 5, an adjustable cam mechanism 46 is interposed between the plunger 20 and the plunger actuating hydraulic cylinder's piston rod 36 and comprises a wedge shaped cam 50 that is slidably received in a guide block 52 that is rigidly fastened to the upper end 53 of the hydraulic cylinder 28 and is guided thereby for movement at right angles to the piston rod and plunger. The cam 50 has a U-shaped notch 56 through which the piston rod 36 extends and through which the plunger 20 extends when the latter is moved to its slug ejecting position as shown in FIG. 8. On the other hand, the plunger 20 has spaced planar surfaces 58 opposite and parallel to an acutely angled flat side 59 of the cam for an abuttable flat surface-to-flat surface relationship therewith during the prepiercing of the part as shown in FIG. 6 and also for the piercing of the part as shown in FIG. 7.

The cam 50 is actuated by a hydraulic cylinder 60 having a piston 61 with a double-ended piston rod 62 that projects from both ends of this cylinder and wherein one end of the piston rod is fastened or coupled to the cam 50 by a necked collar 64 that is formed on this end of the piston rod and is received in a captured condition in a T-shaped slot 66 in the end of the cam adjacent the closed end of the notch 56. The cam actuating hydraulic cylinder 60 is operated with a suitable hydraulic control system to position the cam 50 as described herein by the supply of hydraulic fluid under pressure to and the exhaust of the hydraulic fluid from chambers 68 and 69 at the opposite ends of the piston 61.

The cam actuating hydraulic cylinder 60 is rigidly fastened to the outer side of the side portion 34 of the mounting bracket 33. And precise axial adjustment of the positioning of the piston rod 62 and thus the cam 50 for the prepiercing of the part as shown in FIG. 6 is provided by a disk 70 that is fastened at its center to the other or outer end of the piston rod 62 by a screw 71 and is adjustable relative to the hydraulic cylinder 60 by adjusting screws 72 having a fine thread. Wherein the adjusting screws 72 are threaded through the disk 70 and engage an outer end face 74 of the hydraulic cylinder 60 to precisely stop or limit the extent of piston rod extension and thereby the positioning of the cam 50 during the hydroforming operation as well as precisely limiting the amount of retraction of the plunger for the hydropiercing operation as described in detail later. And wherein the adjusting screws 72 following their adjustment in establishing the desired cam stop position are each locked in place with a jam nut 76.

The cam 50 is also positioned and held by the cam actuating hydraulic cylinder 60 in a partially retracted or intermediate position allowing the plunger 20 to be retracted to its piercing position shown in FIG. 7 and is eventually positioned in a fully retracted position allowing the plunger to be retracted to its slug ejecting position shown in FIG. 8. With such operations accomplished by controlling the supply to and the exhaust of hydraulic fluid from the chambers 68 and 69 of the hydraulic cylinder 60. And wherein in the partially retracted or intermediate cam positions, the acutely angled wedge shaped cam 50 with its hydraulic cylinder 60 acts to hold the plunger 20 against the force of the high hydroforming pressure acting in the part 15 and on the end 24 of the plunger during both the prepiercing operation (FIG. 6) and the actual piercing operation (FIG. 7) thereby relieving the plunger actuating hydraulic cylinder 28 of these duties.

In the prepiercing operation with the plunger 20 in its prepiercing position (FIG. 6), the hydroforming fluid pressure in the part extrudes the section of the part opposite the end 24 of the plunger 20 into the die button bore 19 and over the cutting or shearing edge thereof thereby weakening this section of the part to the degree allowed by this position of the plunger as described in further detail later. Then in the piercing operation that follows with the plunger 20 in its piercing position (FIG. 7), the actual piercing takes place wherein the slug 26 resulting from such piercing is deposited on the end 24 of the plunger 20 and wherein the piercing is possible with a significantly reduced hydroforming pressure because of such weakening of this section of the part. And this is particularly advantageous in that with a reduced hydroforming pressure, the hydroforming fluid is less prone to leakage past the O-ring seal 21 that is provided to maintain a non-leaking volume in the part during the piercing operation.

In the fully retracted positions of the plunger 20 and cam 50 as shown in FIG. 8, the plunger 20 is retracted to and located a certain distance below the die button 18 such that the slug 26 on the end 24 of the plunger is positioned for ejection from the plunger by sideways movement. Wherein the latter is accomplished with an air jet or a liquid such as the hydroforming fluid that is supplied through a nozzle 79 that is mounted in the lower die 10 between the lower end of the die button 18 and the cam 50. An angled chute 80 is also mounted in the lower die 10 with an entryway that is directly opposite the nozzle 79 and collects and directs the slug to exit the lower die by the force of gravity. There additionally being provided a deflector 81 at the exit of the chute 80 to deflect the slug directly downward after exiting the lower die and into a suitable collecting container.

Describing now the setup as well as further details of the operation of the in-die hydropiercing apparatus 16 and with reference to FIG. 1, the inline plunger actuating hydraulic cylinder 28 is adjusted with the screw 40 so that with full extension of this hydraulic cylinder's piston rod 36, the working end 24 of the backup plunger 20 is located thereby in the desired flush position with respect to with respect to the face of the die button 18 for the hydroforming of the part. In addition, the cam actuating hydraulic cylinder's piston rod 62 and thereby the cam 50 is adjusted with the screws 72 so that with full extension of this piston rod and thus the cam and full extension of the plunger 20 in its hydroforming position as shown in FIG. 1, the cam 50 is located so that there is established a certain axial clearance or gap 82 between its acutely angled side 59 and the equally angled end surfaces 58 of the plunger 20 as shown in both FIGS. 1 and 2.

Wherein gap 82 corresponds to the amount of prepiercing or preshearing that is to be allowed by the cam 50 when the plunger 20 following the hydroforming of the part is then retracted to its prepiercing position as determined by the gap then being closed and the angled end surfaces 58 of the plunger being stopped and held by the angle surface 59 of the cam 50 to then allow the hydroforming fluid pressure to prepierce or extrude the part to a limited degree as shown in FIG. 6. For example, a gap 82 equal to about 50%–60% of the wall thickness of the part has been found to produce the desired results in the prepiercing operation and initial adjustments are made accordingly with the adjusting screws 72 for apparatus tryout.

Figure 5:
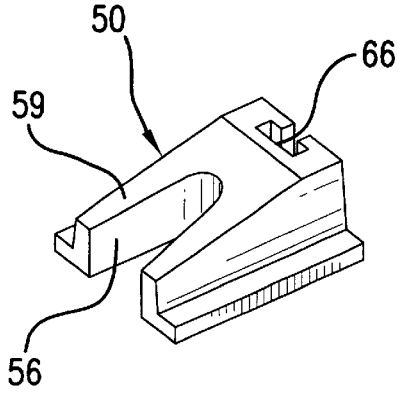
FIG. 5 is a three-dimensional view of the cam in FIG. 1.

With such initial settings established with the adjusting screws 40 and 72, a tryout part is then taken through the entire hydroforming process including the hydroforming operation shown in FIG. 1, the in-die prepiercing operation shown in FIG. 5, the in-die hydropiercing operation shown in FIG. 7, and finally the slug ejection operation shown in FIG. 8. And the hydroformed and pierced part is then examined and whatever adjustments are found to be needed in the hydroforming plunger position and/or the prepiercing plunger position can then be easily and precisely made and locked in with the adjusting screws 40 and 72 and their respective jam nut.

In such processing of the part wherein the part is hydroformed and then immediately following that the prepiercing, piercing, and slug ejecting operations are performed in that sequence with the in-die hydropiercing apparatus 16 described above, the wedge shaped cam 50 that is actuated by the hydraulic cylinder 60 provides a stop for the plunger 20 in its hydropiercing position and also in its piercing position as shown in FIGS. 6 and 7 respectively. And the cam 50 with its hydraulic cylinder 60 thus relieves the plunger actuating hydraulic cylinder 28 of these tasks and because of the acute angle of the cam requires a significantly smaller size hydraulic cylinder and significantly less hydraulic pressure than the plunger actuating hydraulic cylinder 28 in performing these tasks.

Some hydroformed parts may require multiple holes of the same or a different size and/or shape in which case multiple in-die piercing apparatuses like the above-described in-die hydropiercing apparatus 16 can be suitably adapted and employed for the piercing of such holes. Wherein the separate plunger and cam adjustment in each such in-die hydropiercing apparatus allows for individually adjusting the hydroforming and preshearing positions of each backup plunger and especially the latter position that may vary considerably depending on the particular hole required. Moreover, in the case where multiple holes are to be pierced using a corresponding number of in-die hydropiercing apparatuses 16, it was found that they will not all be pierced at exactly the same time as there will be some momentary delay as each slug is pierced from the part.

Wherein such delay results from the hydroforming pressure dropping in the part because of the increased internal volume presented by each retracting plunger. In order to maintain the hydroforming pressure at a sufficiently high level as the piercing continues, additional hydroforming fluid must be supplied to the part to effect such multiple piercing and this is what causes the extent of such momentary delay and wherein a larger hole will increase such delay time because of a corresponding increase in displacement volume that must be supplemented by additional hydroforming fluid supply to the part.

To minimize such delay especially where multiple holes are to be pierced with separate in-die hydropiercing apparatus like that described above, as well as minimize the time for completing the piercing operation where only one hole is to be pierced, it has been found advantageous to also precisely position the cam 50 in a certain adjustable plunger piercing establishing position for the piercing operation so as to minimize the extent of plunger retraction necessary to effect the piercing. This cam position being located intermediate or between the cam's prepiercing plunger establishing position shown in FIG. 6 and the cam's plunger piercing establishing position shown in FIG. 7. And this is simply accomplished by controlling the supply and exhaust of the cam actuating hydraulic cylinder 60 with a proximity switch 90 that is fastened in an adjustable manner on an arm 92 that is rigidly fastened to the mounting bracket 33.

The arm 92 extends longitudinally of the cam actuating hydraulic cylinder 60. And the proximity switch 90 is located through adjustment along the arm 92 so as to sense when the disk 70 and thereby the cam 50 is at a position corresponding to the minimum amount of plunger retraction to be allowed by the cam that is necessary to effect piercing. This adjusted positioning of the disk 70 and thereby that of the cam 50 being illustrated by phantom lines in FIG. 7. The switch 90 then operates a cutoff valve 94 in the hydraulic lines 96 and 98 to the cam actuating hydraulic cylinder chambers 68 and 69 and thereby hydraulically locking this cylinder's piston rod 62 and thus the cam 50 in this intermediate position. Where the cam 50 then limits retraction of the plunger 20 for the piercing operation and thus limits to a controllable degree the amount of internal volume increase during the piercing operation and wherein such volume increase because of adding die button volume to the part during piercing can thus be precisely adjusted and limited to only that necessary to effect a successful piercing. Thereby minimizing the amount of hydroforming fluid that must be added to the part and the accompanying time for doing so in re-establishing sufficient hydroforming fluid pressure for where multiple holes are being pierced using like in-die hydropiercing apparatuses 16. Wherein the additive die button volume increase in all the multiple hydropiercing apparatuses 16 used for such multiple piercing is minimized in like manner.

Furthermore, in the case where multiple holes are being pierced with multiple in-die apparatuses 16, the plunger piercing establishing position of their cam 50 can also be adjusted to suit the particular requirements of the piercing that is required for a particular hole and especially where the holes are of different size and/ or shape and thus have different piercing requirements. And in the case where multiple holes are pierced with multiple in-die apparatuses 16, it will be understood that only after all the holes have been pierced and the hydroforming fluid is exhausted from the hydroformed and pierced part, are their control valves 94 all opened and only then allow their respective cams 50 to be fully retracted and thereby allow their respective plungers 20 to further retract to their slug ejecting position. On the other hand, in the case of a single hole being pierced with a single hydropiercing apparatus 16, the plunger retraction for the piercing operation can be minimized to simply speed up this single piercing operation prior to the slug ejection operation.

Figure 9:
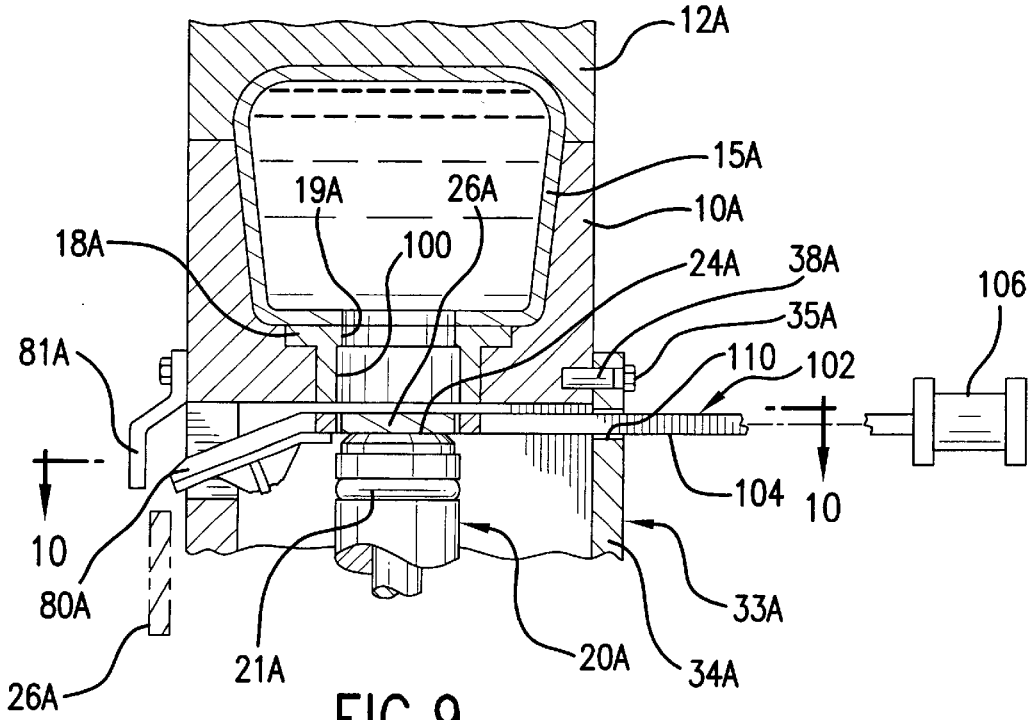
FIG. 9 is a transverse view like FIG. 1 but showing only a sufficient portion of the in-die hydropiercing apparatus wherein an optional mechanical device for ejecting the slugs is substituted for the fluid nozzle in accordance with the present invention.
Figure 10:
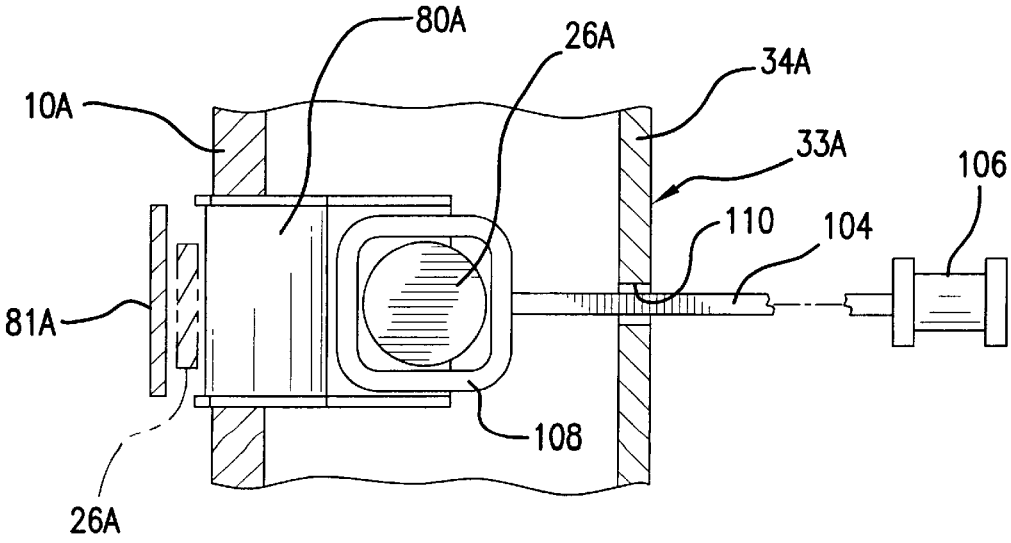
FIG. 10 is a view taken along the line 10—10 in FIG. 9 when looking in the direction of the arrows.

It is further contemplated that the slugs resulting from the piercing may also be ejected by means other than with an air or liquid jet and that the die button may be provided with a relief below its cutting edge to facilitate the depositing of the slugs on to the backup plunger. Such a die button relief and also a mechanism that provides for mechanically ejecting the slugs is shown incorporated in the embodiment of the in-die hydropiercing apparatus shown in FIGS. 9 and 10 wherein the same reference numbers used in FIGS. 1–8 but with the suffix letter "A" added are used to identify like or similar parts and features and new numbers are used to identify certain different parts and features. As shown in FIGS. 9 and 10, the die button 18A is formed with a deep counter-bore 100 in its lower end so as to leave the bore 19A with only a short depth behind the cutting edge that it forms at the face of the die button. And the plunger 20A is provided with stepped cylindrical surfaces accordingly wherein the small diameter portion of the plunger is received in the significantly shortened bore 19A and the large diameter portion of the plunger is received in the counter-bore 100. The counter-bore 100 thus provides a relief behind the cutting edge of the die button 18A that facilitates the depositing of a slug onto the plunger 20A as the slug only has to pass the short distance through the shortened bore 19A and is there after free to travel unhindered to the backup plunger 20A.

Still referring to FIGS. 9 and 10, a slug ejecting mechanism 102 for mechanically ejecting a slug from the end of the plunger 20A is provided that comprises an ejector arm 104 that is connected at one end to a suitable actuator such as a pneumatic cylinder 106 that is suitably rigidly fastened in the in-die hydropiercing apparatus as for example to the mounting bracket 33A. The other end of the arm 104 is formed with a square shaped hoop 108 that is received through an opening 110 in the bracket 33A and below the die button 18A. The hoop 108 is just large enough so that the plunger 20A is free to pass there through and is positioned prior to the piercing operation by the pneumatic cylinder 106 in a slug capturing position as shown where it extends immediately above and about the working end 24A of the backup plunger 20A. Then when a slug 26A is pierced and is deposited on the backup plunger, the hoop 108 captures the slug as shown. The pneumatic cylinder 106 is then operated to extend or push the hoop with the captured slug to a position where the slug drops onto the chute 80A and exits the lower die 10A. It will be appreciated that the slug ejecting mechanism is also adaptable to providing similar slug ejection operation with a pulling action wherein the slug exit chute 80A is simply located on the same side as the slug ejecting actuator 106.

Figure 11:
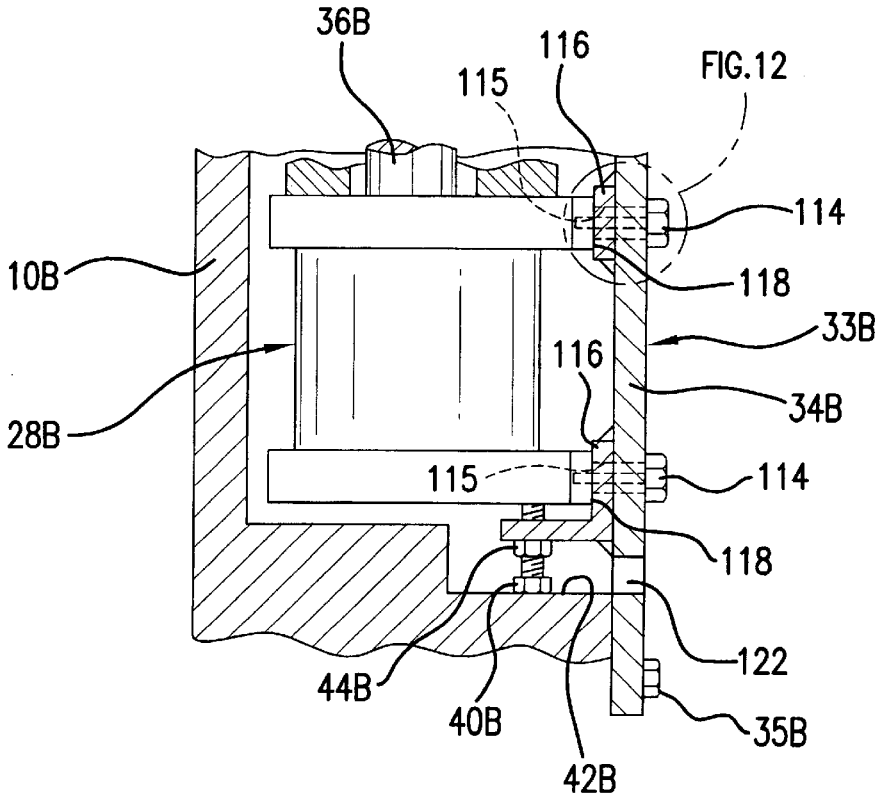
FIG. 11 is a partial transverse view partially in section of an optional mounting of the plunger actuating hydraulic cylinder according to the present invention.
Figure 12:
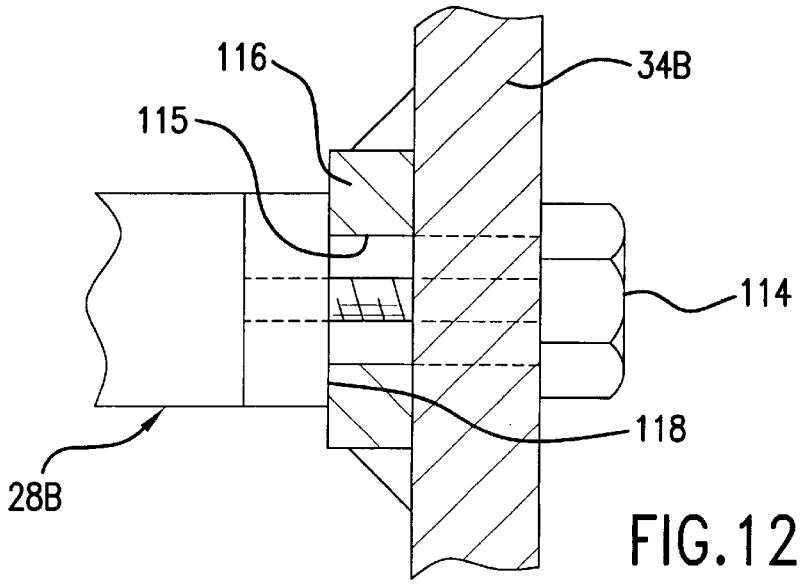
FIG. 12 is an enlarged view of a portion of FIG. 11.

It is also possible to mount the plunger actuating hydraulic cylinder in another simply adjustable manner as shown in FIGS. 11 and 12 wherein the same reference numbers used in FIGS. 1–8 but with the suffix letter "B" added are used to identify like parts or features and new numbers are used to identify certain different parts and features. As shown in FIGS. 11 and 12, the plunger actuating cylinder 28B is now fastened to the side portion 34B of the mounting bracket 33B with screws 114 that pass through vertical slots 115 that extend through the side portion 34B and also through pads 116 that are welded to the inner side of the side portion 34B.

The pads 116 are contacted by flat portions 118 provided on the hydraulic cylinder 28B and the screws 114 are threaded to the hydraulic cylinder 28B at these flat portions to hold the hydraulic cylinder 28B against the pads 116 while allowing when loosened vertical adjustment of the hydraulic cylinder 28B by virtue of their being received in the respective slots 115.

Axial adjustment of the hydraulic cylinder 28B is accomplished by the adjusting screw 40B that contacts the base portion 42B of the lower die 10B and engages the bottom of the hydraulic cylinder 28B as in the previous embodiments but near an outer edge of this end of the hydraulic cylinder instead of at the center as in the previous embodiments. Moreover, the adjusting screw 40B is now threaded to a short horizontal right angle extension of the lower pad 116 instead of to a wide base portion of the mounting bracket as in the previous embodiments and that is thus eliminated by this embodiment. And the screw 40B together with its jamb nut 42B are thus located for more easy access with a wrench through an opening 122 provided in the side portion 34B of the mounting bracket 33B opposite the screw 40B.

It has also been found possible to significantly simplify certain portions of the in-die hydropiercing apparatus and also its operation where multiple holes of essentially equal area and shape are required, such as round holes having about the same diameter. Such a simplified version of the indie hydropiercing apparatus according to the present invention is shown in FIG. 13 wherein the same reference numbers used in FIGS. 1–8 but with the suffix letter "C" added are used to identify like or similar parts and features and new numbers are used to identify certain different parts and features.

Figure 13:
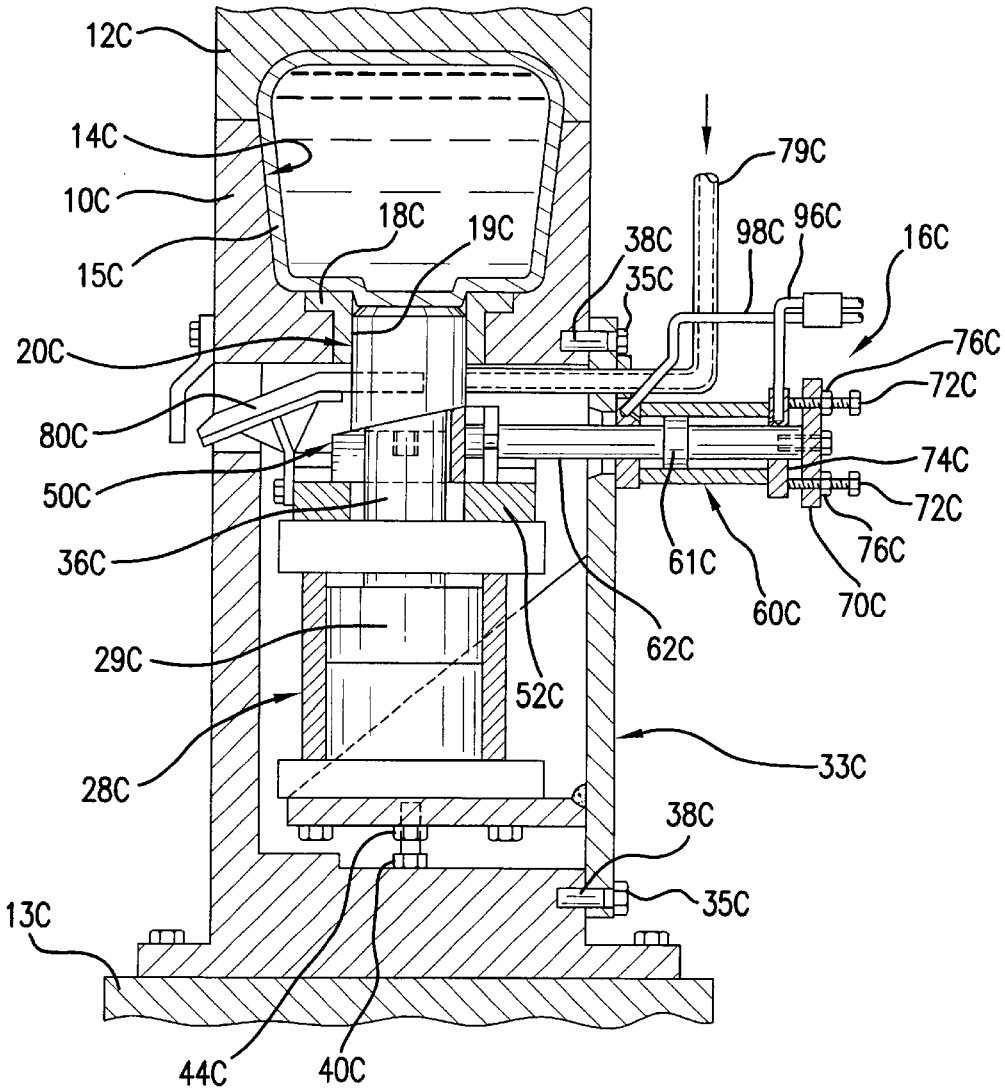
FIG. 13 is a view like FIG. 8 of another embodiment of the in-die hydropiercing apparatus according to the present invention.

Referring to the embodiment in FIG. 13 and for the purpose of piercing multiple holes, multiple hydropiercing apparatuses 16C like that shown and corresponding in number to the number of required holes are used. For such multiple hole piercing, all of the in-die hydropiercing apparatuses 16C are adjusted so as to provide identical plunger prepiercing positions so that there will be the same depth or degree of prepiercing at all of the hole locations prior to the actual piercing. And the like in-die hydropiercing apparatuses are operated simultaneously so that the prepiercing operation at all of the hole locations occurs simultaneously. Following such simultaneous prepiercing with the respective plungers 20C in the in-die hydropiercing apparatuses in their prepiercing position, the plungers are then immediately and simultaneously retracted very rapidly to their piercing position. As a result, the sections in the part being pierced are subjected to a sudden shock pressure that can exceed many times that which is required for the piercing operation. And it has been found that advantage can be taken of this sudden shock loading by retracting the plungers to their piercing position in the shortest possible time by operating their cam 50C to move through, instead of stop at, an immediate position as described previously in the description of the FIGS. 1–8 embodiment.

As a result and through testing using the above method of plunger and cam operation, it was found that there is no need for a seal for the plungers and also no need for a cutoff valve and proximity switch or other sensing means in this application of the hydropiercing apparatus. Since during the simultaneous prepiercing operations with the multiple plungers, the hydroforming fluid remains contained in the hydroformed part and then during the piercing operations, the pressure drop will be minimal because of the very short timing of these operations. And after all the required holes have been simultaneously pierced, the pressure drop and leakage past the plungers are of no significance since such piercing takes place after the part is hydroformed and the fluid needs to be exhausted or dumped anyway before the hydroformed and pierced part can be removed from the dies. Thus resulting in the significantly simplified in-die hydropiercing apparatus 16C shown in FIG. 13 wherein a backup plunger seal, a proximity switch and a cutoff valve are absent in this embodiment.

Moreover, it has been found that in the case of piercing multiple holes by tailoring the prepiercing depth for individual holes of different size, it is also possible to obtain presheared or prepierced areas in the part of different size and depth that will be pierced under the same pressure when the respective plungers 20C in a multiple of in-die hydropiercing apparatuses like apparatus 16C are rapidly retracted to their piercing position. And thus multiple in-die hydropiercing apparatuses like apparatus 16C can be used to pierce multiple holes of the same or different size where they have essentially the same shape and which may be other than a round shape as described later in connection with another embodiment of the present invention.

Where multiple holes of substantially different size and/or shape are required to be pierced, the in-die hydropiercing apparatus embodiments of the present invention described herein other than the in-die hydropiercing apparatus 16C are preferably utilized. Since one or more holes will most likely be pierced before others and because both the backup plunger seal and the intermediate cam position will most likely be needed to provide the most efficient hole piercing operations.

Figure 14:
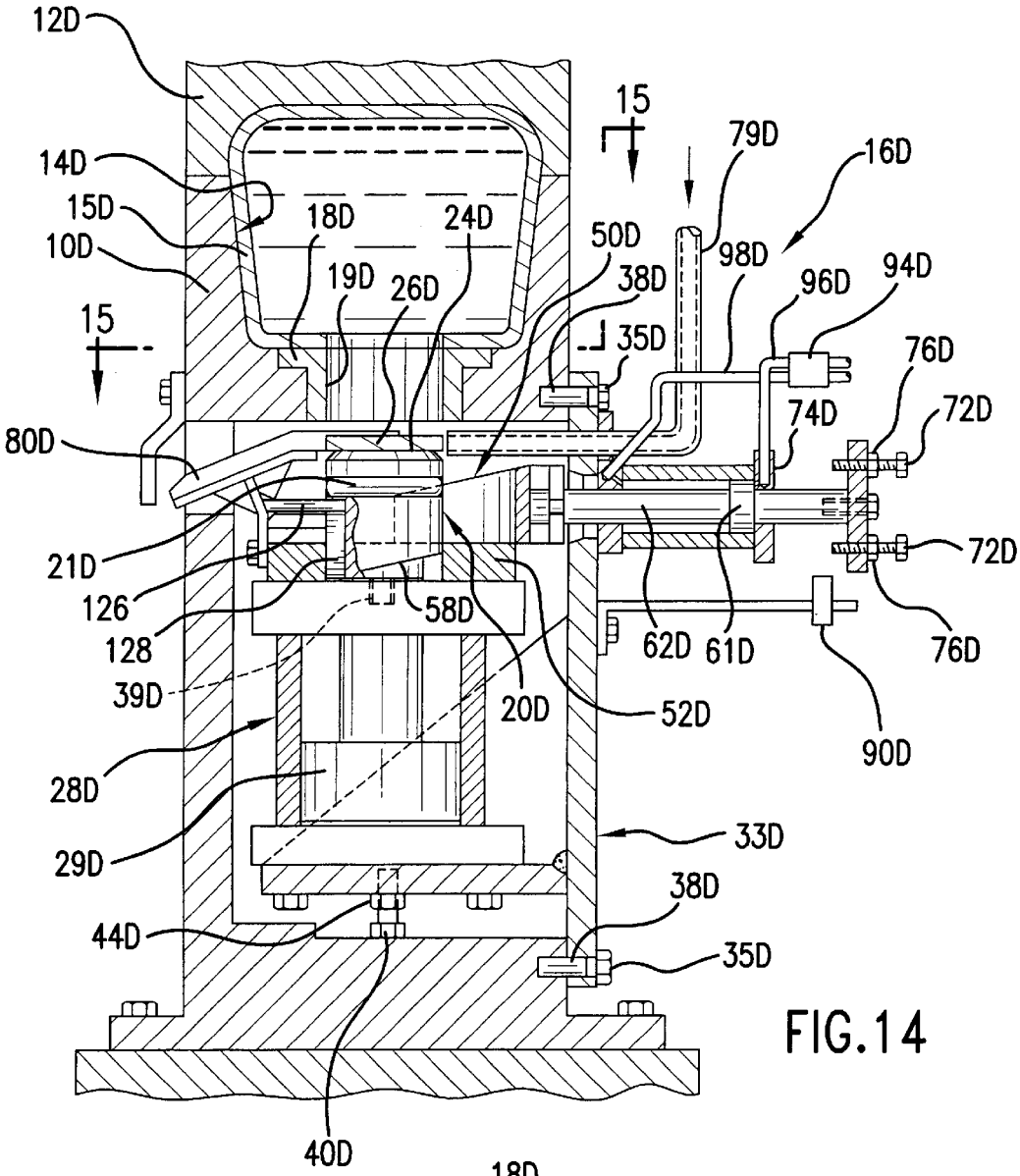
FIG. 14 is a view similar to FIG. 1 of another embodiment of the in-die hydropiercing apparatus according to the present invention.
Figure 15:
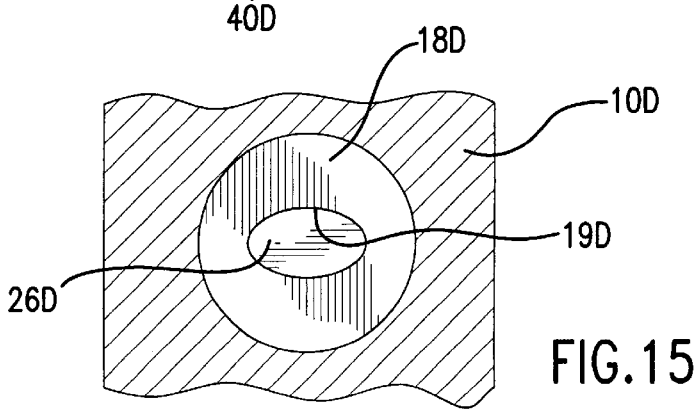
FIG. 15 is a view taken along the line 15—15 in FIG. 14 when looking in the direction of the arrows.

As indicated above, the in-die hydropiercing apparatus of the present invention is also adaptable to piercing non-round holes such as for example an oval shaped hole in a certain orientation in the part and for such required hole piercing, the in-die hydropiercing apparatus is adapted as shown in the embodiment in FIGS. 14 and 15. Wherein the same reference numbers used in FIGS. 1–8 but with the suffix letter "D" added are used to identify like or similar parts and features and new numbers are used to identify certain different parts and features.

Referring to FIGS. 14 and 15, the cylindrical surface of the bore 19D in the die button 18D and that of the plunger 20D are now formed with the required oval shape of the hole. And in order to provide the required orientation of the hole in the part, the die button 18D is fixed in the lower die 10D so as to orient its oval shaped cylindrical bore 19D in line with the orientation of the required hole in the part 15D. In addition, there is provided a guide pin 126 that is rigidly fastened at one end to the chute 80D and is received at its other end in a longitudinally extending guide slot 128 in the side of the plunger 20D.

The guide slot 128 extends from the lower end of the plunger to a point just behind the O-ring seal 21D and the guide pin 126 and slot 128 are angularly located in relation to the angular orientation of the oval shaped cylindrical die button bore 19D so as to maintain proper orientation between the plunger and the die button. As otherwise, the backup plunger 20D when retracted from the die button for slug ejection might turn about its axis to the extent that it is unable to re-enter the die button following a slug ejection operation.

Figure 16:
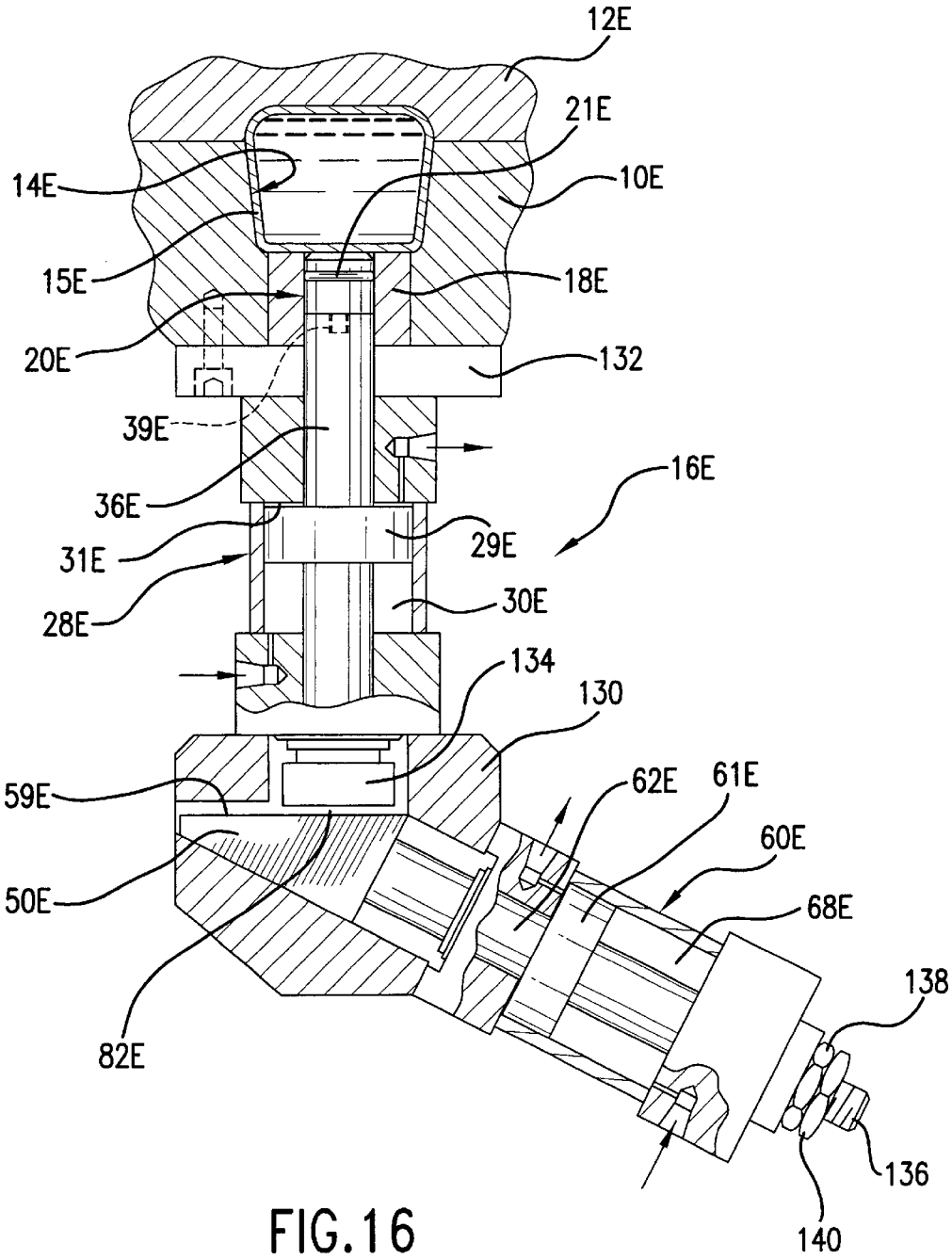
FIG. 16 is a partial transverse view mainly in section of hydroforming apparatus having incorporated therein another embodiment of the in-die hydropiercing apparatus according to the present invention and wherein the backup plunger is shown in its hydroforming position that also serves as its slug ejecting position.
Figure 17:
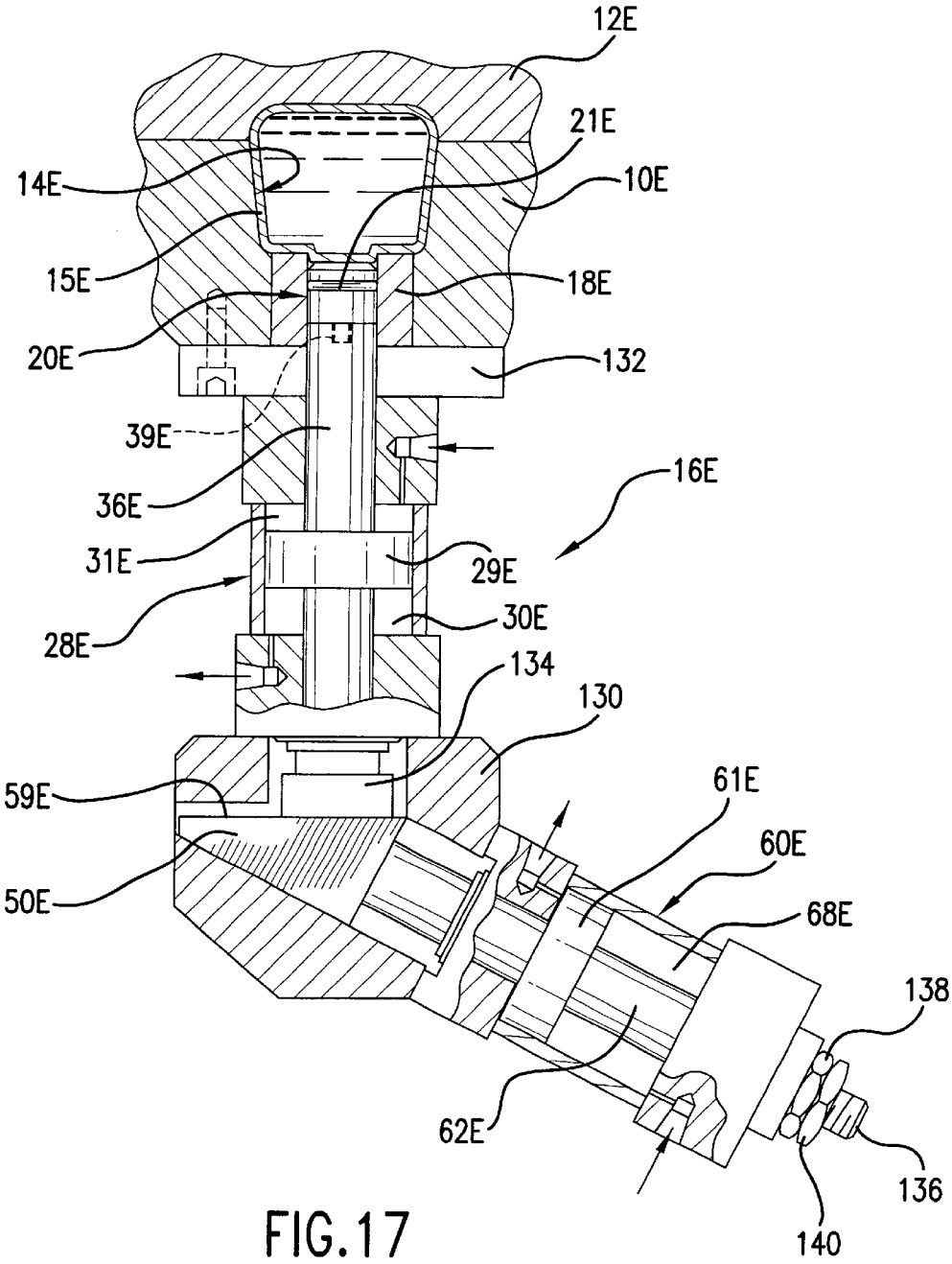
FIG. 17 is a view like FIG. 16 but showing the backup plunger in its prepiercing position.
Figure 18:
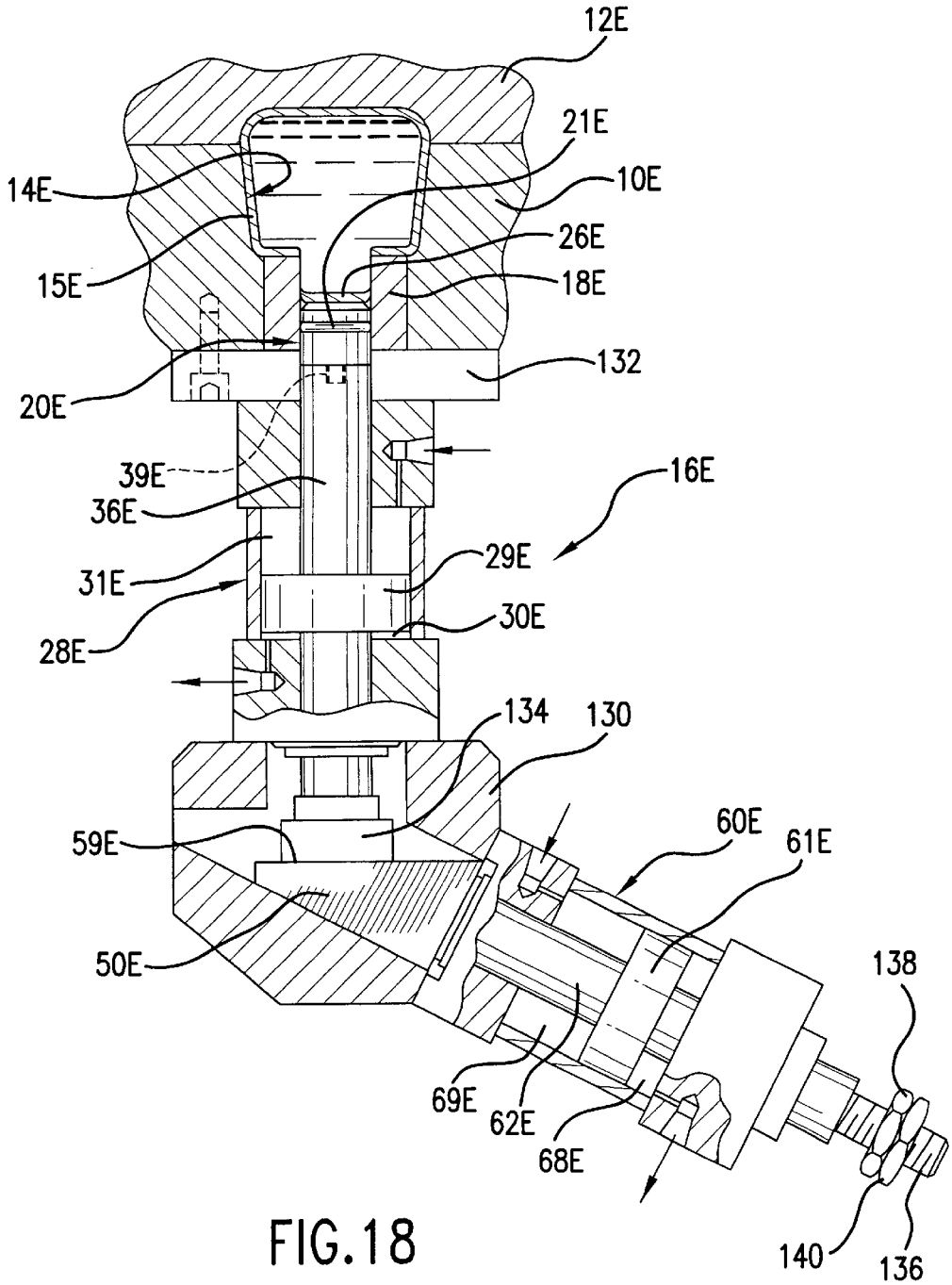
FIG. 18 is a view like FIG. 16 but showing the backup plunger in its piercing position.

The in-die hydropiercing apparatus of the present invention is also adaptable to being packaged in a very compact and unitary manner wherein the plunger and cam actuating hydraulic cylinders are arranged and operate in tandem as shown by the embodiment in FIGS. 16–18. Wherein in FIGS. 16–18, the same reference numbers used in FIGS. 1–8 but with the suffix letter "E" added are used to identify like or similar parts and features and new numbers are used to identify certain different parts and features. And wherein the hydraulic fluid flow to the hydraulic cylinders and the exhaust of the hydraulic flow from these hydraulic cylinders is shown by directional flow arrows.

Describing now the in-die hydropiercing apparatus 16E in FIGS. 16–18, the plunger 20E is fastened by the cap screw 39E to one end (the upper end) of the piston rod 36B of the plunger actuating hydraulic cylinder 28E like in the previous embodiments but now the cam actuating hydraulic cylinder 60E is compactly arranged in tandem with and behind the plunger actuating hydraulic cylinder 28E. And wherein both of the hydraulic cylinders are mounted in the apparatus in a relatively simple and compact manner that eliminates the need for the mounting bracket that supports these actuators in the previously described embodiments.

In the FIGS. 16–18 embodiment, the hydraulic cylinders 28E and 60E are rigidly fastened together by a cam guide block 130 and are rigidly mounted on the lower die 10E directly beneath the die cavity 14E by a mounting plate 132 that is sandwiched between the lower die and the plunger actuating hydraulic cylinder 28E. And wherein the mounting plate 132 also acts to hold the die button 18E in place in the lower die by abutting with the lower end of the die button thereby eliminating the need for a retention shoulder on the die button 18E as in the previously described embodiments.

Moreover, in this embodiment the piston rod 36E of the plunger actuating hydraulic cylinder 28E is also double-ended and extends from both ends of this cylinder like the piston rod 62E of the cam actuating hydraulic cylinder 60E. And the wedge shaped cam 50E is now interposed between the hydraulic cylinders 20E and 60E, is rigidly fastened to the projecting upper end of the piston rod 62E of the cam actuating hydraulic cylinder 60E, and engages at its acutely angled side 59E with a pad 134 that is rigidly fastened to the lower end of the piston rod 36E that now projects from the lower end of the plunger actuating hydraulic cylinder 28E.

In this arrangement and assembly of the hydropiercing apparatus as shown in FIG. 16, the hydroforming position of the plunger 20E, which also serves as the slug ejecting position as explained later, is determined by the piston 29E of the plunger actuating hydraulic cylinder 28E abutting with the upper end of this hydraulic cylinder when hydraulic fluid under pressure is supplied to the chamber 30E while the other chamber 31E is exhausted. And the wedge shaped cam 50E is now a relatively simple part absent a notch and a T-slot like in the previous embodiments, is received in and guided by the guide block 130 that joins the hydraulic cylinders 28E and 60E, and is now simply rigidly connected to the piston rod 62E of the cam actuating hydraulic cylinder 60E.

The other end of the piston rod 62E that projects from the opposite end of the cam actuating hydraulic cylinder 60E is now formed with a fine thread 136 that receives an adjusting nut 138 and a jam nut 140. Referring to FIG. 16, the adjusting nut 138 is abuttable with this end of the hydraulic cylinder 60E and in setting up the apparatus, the adjusting nut 138 is adjusted to position the cam 50E so as to set the gap 82E between the plunger 20E and the cam 50E equal to the desired plunger prepiercing travel distance. With the gap 82E being set while the plunger 20E is located and held in its hydroforming position by the piston rod 36E of the plunger actuating hydraulic cylinder 28E when its chamber 30E is supplied with hydraulic fluid under pressure and its chamber 31E is exhausted. And while the piston rod 62E of the cam actuating hydraulic cylinder 60E and thus the cam 50E are positioned in their maximum extended position by the supply of hydraulic fluid under pressure to the chamber 68E in the cam actuating hydraulic cylinder 60E while its other chamber 67E is exhausted. With the desired gap 82E thus established, the jam nut 140 is then tightened against the adjusting nut 138 to fix the maximum extended position of the cam actuating piston rod 62E for repeated operations in re-establishing the gap 82E.

The in-die hydropiercing apparatus 16E is operated in a manner like the sequence of operations of the in-die hydropiercing apparatus 16 shown in FIGS. 1, 6 and 7 as previously described. Wherein the backup plunger 20E is effectively positioned by the hydraulic cylinders 28E and 60E for the hydroforming operation as shown in FIG. 16, is also effectively positioned thereby for the prepiercing operation as shown in FIG. 17, and is also effectively positioned thereby for the piercing operation as shown in FIG. 18. But instead of providing the backup plunger 20E with a fourth position for slug ejection following the piercing operation as in the previous embodiments, the plunger 20E with a slug 26E having been deposited thereon is now simply returned by the plunger actuating hydraulic cylinder 28E to its hydroforming position shown in FIG. 16 following the exhaust of the hydroforming fluid from the hydroformed and pierced part and removal of the finished part from the lower die 10E. Where after, the slug is easily removed from the plunger 20E such as with a robot.

Having described several exemplary embodiments of the present invention and their manner of operation, it will be appreciated that other forms of the in-die hydropiercing apparatus of the present invention are possible. For example, the part as formed may require a hole in a contoured portion of the hydroformed part and in that case the outer surface of the die button and the working end of the plunger would be configured accordingly, if need be, in order to effect the required piercing and particularly where such contoured portion to be pierced has considerable curvature. A further example is the location of the hydropiercing apparatus on the upper die instead of on the lower die. In the latter example and in the case of the indie hydropiercing apparatus 16E, the slug would then simply drop onto the lower die for removal after the finished part has been removed and the plunger then returned with the slug to the plunger's hydroforming position.

The above-disclosed exemplary embodiments are thus intended to be illustrative of the invention and it is foreseeable that various modifications thereof will become apparent to those skilled in this art from this enabling disclosure. And therefore it is intended that the present invention be limited only by the scope of the appended claims.

What is claimed is:

1. In-die hydropiercing apparatus comprising a die button adapted to be mounted in a hydroforming die, a backup plunger received in said die button having an end adapted to be positioned in at least (1) a hydroforming position flush with an outer surface of said die button during hydroforming of a part with hydroforming fluid under pressure and (2) a retracted prepiercing position in said die button for prepiercing of the part with the hydroforming pressure in the part and (3) a further retracted piercing position in said die button for piercing the part with the hydroforming pressure in the part, cam means for determining the positioning of said plunger in said prepiercing position, plunger actuating means for moving said plunger to said positions, and cam actuating means including adjusting means for actuating said cam means to position and hold said plunger in said prepiercing position independent of said plunger actuating means and to also adjust said prepiercing position.

2. In-die hole hydropiercing apparatus as set forth in claim 1 wherein said plunger actuating means includes adjusting means for adjusting said hydroforming position.

3. In-die hydropiercing apparatus as set forth in claim 1 wherein said cam means comprises a wedge shaped cam having an acutely angled side that engages a correspondingly angled surface of said plunger.

4. In-die hydropiercing apparatus as set forth in claim 1 wherein said cam means comprises a wedge shaped cam having an acutely angled side that engages a correspondingly angled surface of said plunger and wherein a prescribed gap is established between said plunger and said cam with said adjusting means when said plunger is in said hydroforming position to thereby determine said prepiercing position of said plunger.

5. In-die hydropiercing apparatus as set forth in claim 1 wherein said cam actuating means is also adapted to hold said plunger in said piercing position independent of said backup plunger actuating means.

6. In-die hydropiercing apparatus as set forth in claim 1 wherein a slug resulting from the piercing operation is deposited on said plunger, said plunger actuating means is also operable to position said plunger in a slug ejecting position outside said die button, and said cam actuating means is also operable to move said cam means directly from a fully extended position determining said prepiercing position of said plunger to a fully retracted position while said plunger is moved by said plunger actuating means from said prepiercing position to said piercing position.

7. In-die hydropiercing apparatus as set forth in claim 1 wherein said cam means is positioned by said cam actuating means in a prescribed intermediate position between a fully extended position and a fully retracted position in determining said piercing position of said plunger, and said intermediate position of said cam means is determined by sensing means sensing when said cam means is positioned in said intermediate position.

8. In-die hydropiercing apparatus as set forth in claim 1 wherein said plunger is also positioned by said plunger actuating means in a slug ejecting position outside of said die button for ejecting a slug deposited on said plunger in said piercing operation, and a nozzle for directing a fluid to eject said slug from said plunger when said plunger is in said slug ejecting position.

9. In-die hydropiercing apparatus as set forth in claim 1 wherein said plunger is also positioned by said plunger actuating means in a slug ejecting position outside of said die button for ejecting a slug deposited on said plunger in said piercing operation, and mechanical means for ejecting said slug from said plunger when said plunger is in said slug ejecting position.

10. In-die hydropiercing apparatus as set forth in claim 1 wherein said plunger is also positioned by said plunger actuating means in a slug ejecting position outside of said die button for ejecting a slug deposited on said plunger in said piercing operation, and an air ejecting nozzle for directing an air jet to eject said slug from said plunger when said plunger is in said slug ejecting position.

11. In-die hydropiercing apparatus as set forth in claim 1 wherein said plunger is also positioned by said plunger actuating means in a slug ejecting position for ejecting a slug deposited on said plunger in said piercing operation, and a liquid ejecting nozzle for directing a liquid jet to eject said slug from said plunger when said plunger is in said slug ejecting position.

12. In-die hydropiercing apparatus as set forth in claim 1 wherein said plunger is also positioned by said plunger actuating means in a slug ejecting position outside of said die button for ejecting a slug deposited on said plunger in said piercing operation, and a hoop adapted to capture and eject said slug from said plunger in either one of two directions when said plunger is in said slug ejecting position.

13. In-die hydropiercing apparatus as set forth in claim 1 wherein said cam means is positioned by said cam actuating means in a prescribed intermediate position between a fully extended position and a fully retracted position in determining said piercing position of said plunger, and control means including a proximity switch adapted to sense when said cam means is positioned in said intermediate position and operate said cam actuating means to hold said cam means in said intermediate position.

14. In-die hydropiercing apparatus as set forth in claim 1 wherein said plunger is also positioned by said plunger actuating means in a slug ejecting position outside of said die button for ejecting a slug deposited on said plunger in said piercing operation, and means for preventing turning of said plunger relative to said die button when said plunger is moved between said piercing position and said slug ejecting position.

15. In-die hydropiercing apparatus as set forth in claim 1 wherein said plunger actuating means and said cam actuating means are arranged in tandem.

16. In-die hydropiercing apparatus as set forth in claim 1 wherein said plunger actuating means comprises a hydraulic cylinder having a plunger actuating piston rod, said plunger is connected to one end of said plunger actuating piston rod, said cam actuating means comprises a hydraulic cylinder having a cam actuating piston rod, and said cam is received about said plunger actuating piston rod and is connected to said cam actuating piston rod and has an acutely angle side engaging correspondingly angled surfaces on said one end of said plunger.

17. In-die hydropiercing apparatus as set forth in claim 1 wherein said plunger actuating means comprises a hydraulic cylinder having a plunger actuating piston rod, said plunger is connected to said plunger actuating piston rod, said cam actuating means comprises a hydraulic cylinder having a cam actuating piston rod arranged at an angle to said plunger actuating piston rod, and said cam is connected to said cam actuating piston rod and has an acutely angle side engaging a correspondingly angled end of said plunger actuating piston rod.

18. In-die hydropiercing apparatus as set forth in claim 1 wherein said plunger actuating means comprises a hydraulic cylinder having a plunger actuating piston rod, said plunger is connected to one end of said plunger actuating piston rod, said cam actuating means comprises a hydraulic cylinder having a cam actuating piston rod, said cam received about said plunger actuating piston rod and connected to said cam actuating piston rod and having an acutely angle side engaging correspondingly angled surfaces on said one end of said plunger, and said adjusting means comprises a threaded device for adjusting the positioning of said cam actuating piston rod when in a fully extended position to thereby adjust said cam and thereby said prepiercing position of said plunger.

19. In-die hydropiercing apparatus as set forth in claim 1 wherein said plunger actuating means comprises a hydraulic cylinder having a plunger actuating piston rod, said plunger is connected to said plunger actuating piston rod, said cam actuating means comprises a hydraulic cylinder having a cam actuating piston rod arranged at an angle to said plunger actuating piston rod, said cam connected to said cam actuating piston rod and having an acutely angle side engaging a correspondingly angled end of said plunger actuating piston rod, and said adjusting means comprises a threaded device for adjusting the positioning of said cam actuating piston rod when in a filly extended position to thereby adjust said cam and thereby said prepiercing position of said plunger.

20. In-die hydropiercing apparatus as set forth in claim 1 wherein said plunger carries an elastomeric seal engaging said die button, and said die button has an elastomeric seal adapted to engage the part about said plunger.

21. In-die hydropiercing apparatus as set forth in claim 1 wherein said hydroforming position of said plunger is also a slug ejecting position.

22. In-die hydropiercing apparatus as set forth in claim 1 wherein said plunger actuating means comprises an adjustable hydraulic cylinder, and adjusting means for adjusting said hydraulic cylinder to thereby establish said bydrofoming position of said plunger.

23. In-die hydropiercing apparatus as set forth in claim 1 wherein said plunger-actuating means comprises a hydraulic cylinder having a piston rod connected to said plunger and engaged by said cam means.

24. In-die hydropiercing apparatus as set forth in claim 1 wherein said plunger actuating means comprises a hydraulic cylinder having a piston rod connected to said plunger and engaged by said cam means, and said cam actuating means comprises a hydraulic cylinder connected at an angle to said first mentioned hydraulic cylinder and having a piston rod connected at one end to said cam means and adjustably connected at another end by said adjusting means to thereby adjust said prepiercing position of said plunger.

25. In-die hydropiercing apparatus as set forth in claim 1 wherein said plunger actuating means comprises a hydraulic cylinder, said cam means comprises a guide block fastened to said hydraulic cylinder and a wedge shaped cam received and guided by said guide block wherein said cam has an acutely angled side engaging a correspondingly angled surface of said plunger.

26. A plurality of in-die hydropiercing apparatuses each comprising a die button adapted to be mounted in a hydroforming die, a backup plunger received in said die button having an end adapted to be positioned in at least (1) a hydroforming position during hydroforming of a part with hydroforming fluid under pressure and (2) a retracted prepiercing position for prepiercing of the part with the hydroforming pressure in the part and (3) a further retracted piercing position for piercing the part with the hydroforming pressure in the part and (4) a slug ejecting position allowing for ejection of a slug deposited on to the end of the backup plunger resulting from piercing of the part, plunger actuating means for moving said plunger to said positions, cam means for determining the positioning of said plunger in said prepiercing position and said slug ejecting position, cam actuating means including adjusting means for actuating said cam means to position and hold said plunger in said prepiercing position independent of said plunger actuating means and to also adjust said prepiercing position, and wherein the cam means in said apparatuses are adapted to be simultaneously moved from a plunger prepiercing determining position directly to a plunger piercing determining position thereby allowing simultaneous movement of the plungers in said apparatuses from their said prepiercing position to their said piercing position.

27. A plurality of in-die hydropiercing apparatuses each comprising a die button adapted to be mounted in a hydroforming die, a backup plunger received in said die button having an end adapted to be positioned in at least (1) a Hydroforming position flush with an outer surface of said die button during hydroforming of a part with hydroforming fluid under pressure and (2) a retracted prepiercing position in said die button for prepiercing of the part with the hydroforming pressure in the part and (3) a further retracted piercing position in said die button for piercing the part with the hydroforming pressure in the part and (4) a further retracted slug ejecting position outside said die button, plunger actuating means for moving said plunger to said positions, cam means for determining the positioning of said plunger in said prepiercing position and said slug ejecting position, cam actuating means including adjusting means for actuating said cam means to position and hold said plunger in said prepiercing position independent of said plunger actuating means and to also adjust said prepiercing position, and wherein the cam means in said apparatuses are adapted to be simultaneously moved from a plunger prepiercing determining position directly to a plunger slug ejection determining position thereby allowing simultaneous movement of the plungers in said apparatuses from their said prepiercing position through their said piercing position to their said slug ejecting position.

* * * * *